United States Patent [19]

Mavroudis

[11] Patent Number: 4,903,616

[45] Date of Patent: Feb. 27, 1990

[54] DEVICE FOR SUPPLY OF SECONDARY AIR, AND BOILER WITH THE DEVICE

[76] Inventor: Konstantin Mavroudis, Götgatan 91 B, S-116 62 Stockholm, Sweden

[21] Appl. No.: 144,031

[22] PCT Filed: May 5, 1987

[86] PCT No.: PCT/SE87/00227

§ 371 Date: Jan. 12, 1988

§ 102(e) Date: Jan. 12, 1988

[87] PCT Pub. No.: WO87/06999

PCT Pub. Date: Nov. 19, 1987

[30] Foreign Application Priority Data

May 12, 1986 [SE] Sweden ..... 8602124

[51] Int. Cl.[4] ..... F23B 7/00; F23J 5/04

[52] U.S. Cl. ..... 110/234; 110/211; 110/213; 110/214

[58] Field of Search ..... 110/210–214, 110/233–235, 263–265, 102, 302–304; 122/15, 22, 44 R, 114, 48

[56] References Cited

U.S. PATENT DOCUMENTS

| | | | |
|---|---|---|---|
| 1,523,508 | 1/1925 | Bibb . | |
| 2,452,843 | 11/1948 | Esnault-Pelterie . | |
| 3,022,753 | 2/1962 | Montgomery | 110/102 |
| 3,567,399 | 3/1971 | Altmann et al. | 110/213 X |
| 3,834,327 | 9/1974 | Hellstrom et al. | 110/234 X |
| 3,844,233 | 10/1974 | Fishback | 110/234 X |
| 3,855,951 | 12/1974 | Giles | 110/234 X |
| 4,145,979 | 3/1979 | Lilley et al. | 110/214 X |
| 4,332,206 | 6/1982 | Tucker et al. | 110/212 X |
| 4,395,958 | 8/1983 | Caffyn et al. | 110/211 X |
| 4,458,662 | 7/1986 | Barnett | 110/214 X |

FOREIGN PATENT DOCUMENTS

| | | |
|---|---|---|
| 22025 | 3/1917 | Denmark . |
| 128398 | 6/1950 | Sweden . |
| 213725 | 3/1941 | Switzerland . |
| 682302 | 11/1952 | United Kingdom . |

*Primary Examiner*—Henry C. Yuen

*Attorney, Agent, or Firm*—Shapiro and Shapiro

[57] ABSTRACT

The high efficiency solid fuel combustion apparatus comprises a thermally insulated wall structure defining an upwardly open primary combustion chamber, a solid fuel support disposed within the primary combustion chamber, and a secondary combustion air supply device mounted on top of the primary combustion chamber. The secondary air supply device comprises a frusto-conical shell open at both axial ends and oriented with its larger axial end opening to the primary combustion chamber. The shell has spaced inner and outer walls defining a frusto-conical air space there between, with the inner and outer walls being circumferentially sealed to one another and the inner wall being perforated for expelling secondary combustion air into the pyrolytic gasses generated by the burning fuel in the primary combustion chamber. The solid fuel support may include a horizontal lower grate and two inclined side grates fitted with primary air guide vanes to direct primary air onto the charcoal residue that accumulates on the horizontal grate.

10 Claims, 12 Drawing Sheets

FIG. 1
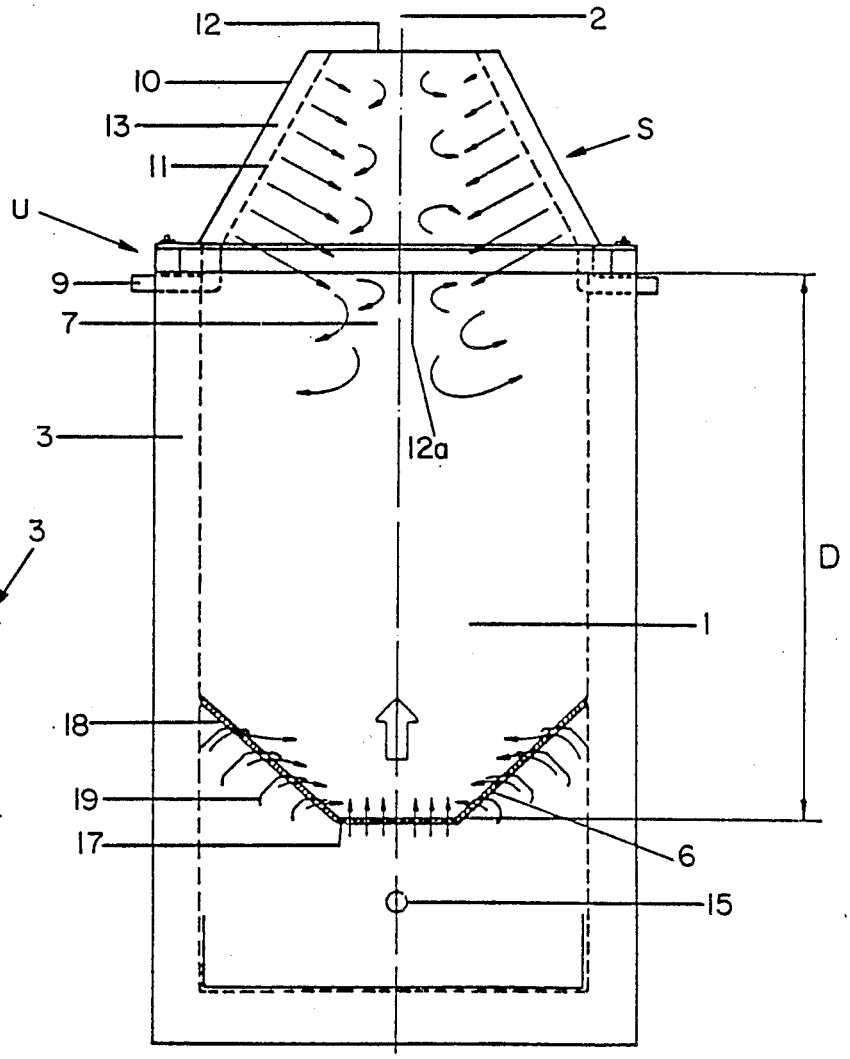
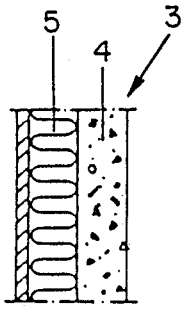
FIG. 1A

FIG. 9
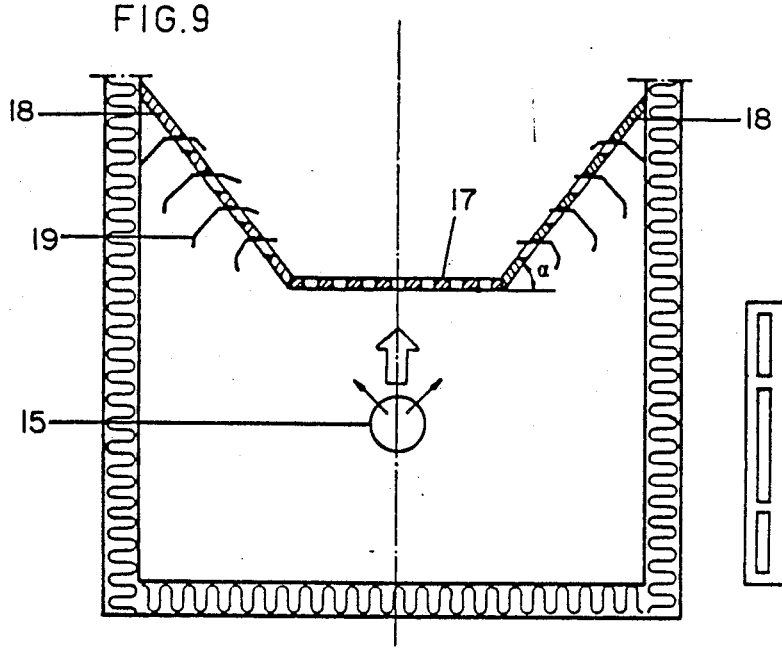
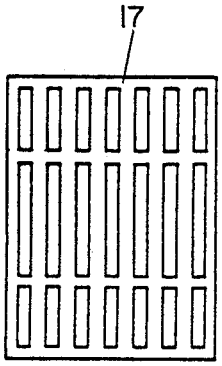
FIG. 9B
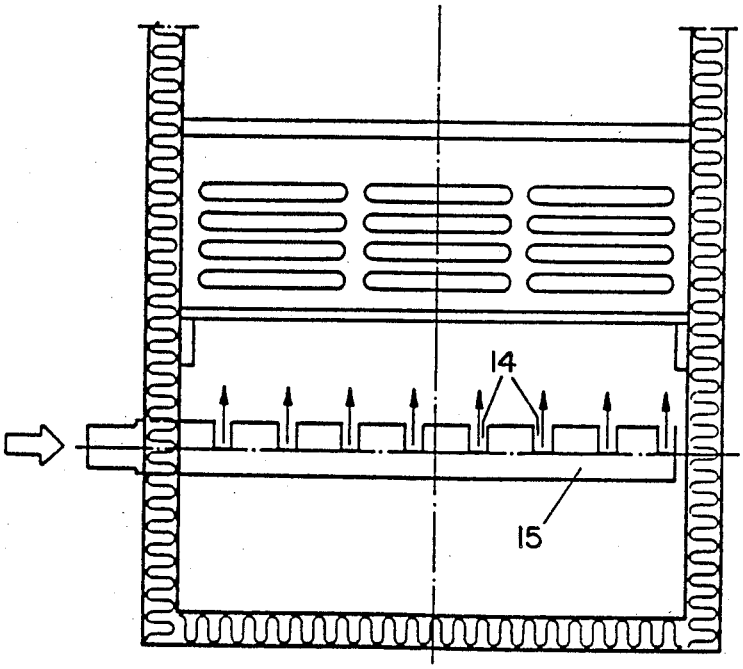
FIG. 9A

FIG. 10
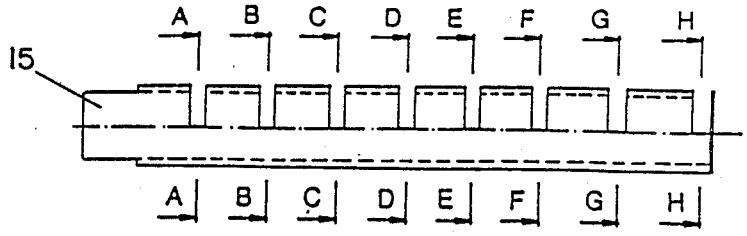
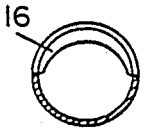
FIG. 10A
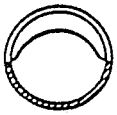
FIG. 10B
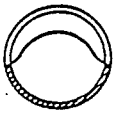
FIG. 10C
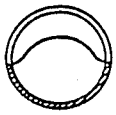
FIG. 10D
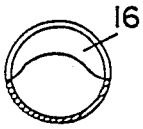
FIG. 10E
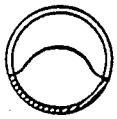
FIG. 10F
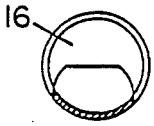
FIG. 10G
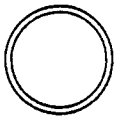
FIG. 10H
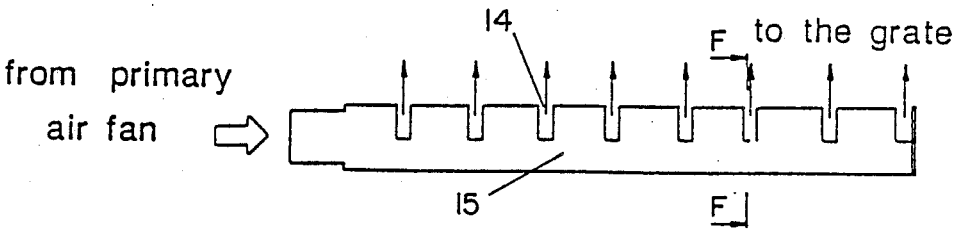
FIG. 11
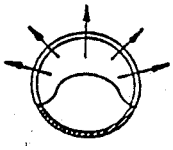
FIG. 11A

DEVICE FOR SUPPLY OF SECONDARY AIR, AND BOILER WITH THE DEVICE

BACKGROUND OF THE INVENTION

This invention is for use with a solid-fuel-fired boiler with high combustion and system efficiency. The high level of emissions and low efficiency associated with the use of solid fuels has been an obstacle to the transition from oil to solid fuels. There is a clear need for a suitable solid-fuel-fired boiler that fulfills strict environmental standards and achieves high efficiency performance as well.

A solid fuel, e.g. wood in various forms such as logs, chips, pellets or peat, differs fundamentally from oil in its combustion properties. For example, wood burns in two widely differing phases: the Gas Combustion Phase and the Charcoal Phase. Both emissions and heat are formed and emitted in these two phases. In the former phase about 80% of the fuel mass is converted to gases in a relatively short time. Thus the gas volume and the rate of emission of the volatile matter depend on an important factor, the moisture content of the fuel. High moisture levels result in a long gas combustion phase. For a conventional boiler it has been shown that the gas combustion phase is critical from the environmental and heat transfer viewpoint. There are many physical and chemical factors at work during the gas combustion phase that affect the pattern of emissions. They will not be dealt with here. The most important factor in this context is the air supply, which will be discussed shortly.

In general, the charcoal phase involves about 20% of the total fuel mass, although the combustion time can actually be longer than that for the gas phase. The charcoal phase is not so much of concern regarding emissions, mainly because of the even and uncomplicated combustion. Even so, the supporting grate should be designed and shaped correctly to maintain a high combustion efficiency.

SUMMARY OF THE INVENTION

The present invention provides combustion apparatus which assures high efficiency combustion and low emissions during both the gas and charcoal phases of combustion. The apparatus may comprise a thermally insulated wall structure defining an upwardly open primary combustion chamber, means disposed in the primary combustion chamber for supporting a solid fuel for combustion, and a secondary combustion air supply device mounted above the primary combustion chamber. In accordance with the invention, the secondary air supply device comprises a frusto-conical shell open at both axial ends and oriented with the larger axial end opening to the primary combustion chamber. The shell has spaced inner and outer walls defining a frusto-conical air space therebetween, with the inner and outer walls being circumferentially sealed to one another near the axial ends of the shell, and the inner wall being perforated. Secondary air supply duct means is connected to the shell in communication with the frusto-conical air space for supplying secondary air to be ejected through the perforations of the inner wall into the exhaust gas stream generated by the fuel burning in the primary combustion chamber.

In a preferred form of the invention, the fuel supporting means comprises a grate having a horizontal central section and two upwardly inclined side sections, so that charcoal formed during the combustion process will accumulate on the horizontal section. The side sections are provided with primary air guide vanes. As the pressure drop across the central portion increases with increasing charcoal accumulation, the guide vanes redirect the primary air flow through the side grates toward the accumulated charcoal, thus ensuring continued intense combustion.

BRIEF DESCRIPTION OF THE DRAWINGS

The invention will be described in detail hereinafter with reference to the accompanying drawings in which:

FIG. 1 is a diagrammatic part-sectional view of a combustion unit according to the invention;

FIG. 1A is an enlarged sectional view of a wall portion of the combustion unit;

FIGS. 9 and 9A are diagrammatic front and side sectional views, respectively, of the lower portion of the combustion unit, including the fuel grate and primary air supply duct;

FIG. 9B is a top view of the central section of the fuel grate;

FIG. 10 is a diagrammatic side view of the primary air supply duct;

FIGS. 10A–10H are cross sections of the primary air supply duct taken respectively along lines A—A through H—H of FIG. 10;

FIGS. 11 and 11A illustrate the air flow through the primary air duct, FIG. 11A being a section along line F—F of FIG. 11;

DETAILED DESCRIPTION OF THE INVENTION

Figure 13:
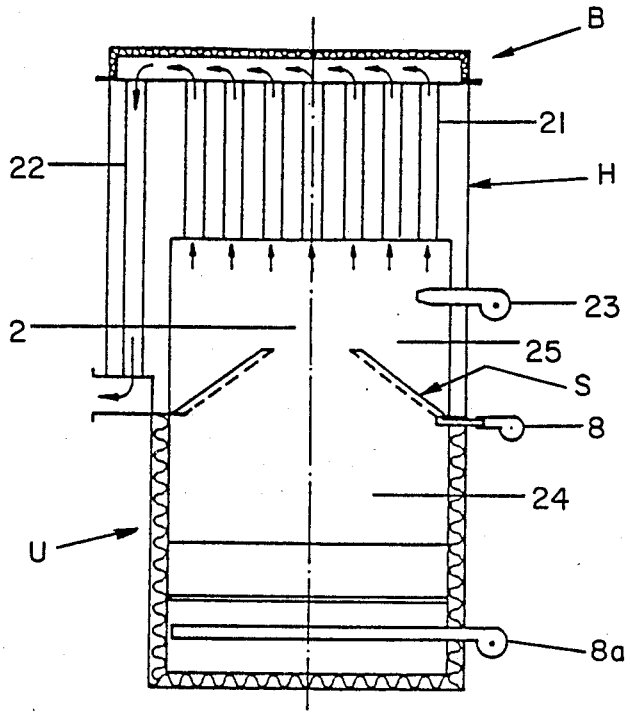
FIG. 13 is a diagrammatic illustration of a boiler incorporating the combustion unit and heat exchanger of FIGS. 1 and 12, respectively.

FIGS. 1 and 13 respectively show a combustion unit U in accordance with the invention, and a boiler B incorporating the combustion unit. Combustion in the illustrative unit is based on the so-called two-stage principle. This means that combustion takes place in two separate chambers, a primary combustion chamber (1) and a secondary combustion chamber (2). The primary combustion chamber is defined by a wall (3) ceramically insulated with flame-proof brick (4) next to the chamber, and a high quality silicon-based insulation material (5). The low thermal conductivity of both materials at temperatures of combustion results in extremely small radiation losses from the wall of the combustion chamber. Primary air is conveyed to a fuel bed (6) by means of a microprocessor-controlled fan (8*a*), shown in FIG. 13.

The entire fuel mass (for example 7–12 kg of logs depending on the moisture content) is ignited, and the primary air flow adjusted to give under-stochiometric conditions in the primary combustion chamber. This can be regarded as a pyrolysis stage, where the pyrolytic gases are characterized by a severe oxygen deficit and high levels of combustible gases, mainly carbon monoxide and various hydrocarbons.

One to three minutes after ignition in the primary combustion chamber, the combustion temperature becomes sufficiently high for the pyrolytic gases in the secondary combustion chamber to self-ignite by additional oxygen being conveyed in the secondary air. The secondary air is driven to a mixing zone (7) by a secondary-air fan (8), shown in FIG. 13, through two ducts (9) and a double-jacketed device S in the shape of a frustoconical shell. The inner and outer jackets (11), (10) are concentric and joined gas tight to each other along the whole periphery of the top and bottom of the device S, i.e. along both the periphery at large opening (12*a*) to the primary combustion chamber and at the smaller opening (12) formed by the truncation at the mouth of the device. The diameter of the latter opening is determined experimentally and has been shown to be important for the function of the secondary combustion stage. Large diameters result in delayed or unsatisfactory ignition, while small diameters cause high velocities through the hole, which can lead to the flame being blown out or can give rise to pulsating combustion, i.e. intermittent ignition and extinguishing of the flame. The inner jacket (11) is perforated with a large number of symmetrically distributed holes which may be 3–5 mm in diameter.

Owing to the high pressure generated by the secondary air fan, air jets of high velocity are obtained. The result is a secondary air flow of high pressure directed to the top of the flame, which balances the pressure generated from the primary air fan. This leads to effective mixing of the oxygen and the combustible gases, as well as longer residence time of the gases in the combustion chamber. At the mouth of the device (12) burns a small gas flame whose height is adjusted according to the pressure difference between the secondary and primary air fans.

The height of the flame in the secondary combustion chamber normally varies between 10 and 30 cm, for example, depending on the amount of fuel and its moisture content. The volume and height of the secondary combustion chamber are chosen so that the flame never comes into direct contact with the water-cooled boiler walls disposed above the chamber in a manner described later.

There is another important advantage with the double-jacketed conical design. In spite of the high pressure prevailing in the enclosed space (13) between the jackets (10), (11), the secondary air has a relatively long residence time. This means that the secondary air is warmed up considerably before it takes part in the combustion. Quicker and easier ignition of the combustible gases is thus obtained, together with more favorable emissions. Because of the high combustion temperatures in the secondary combustion chamber, heat-resistant materials should be chosen for the device S.

The secondary air fan is preferably also electronically controlled. The set values may be determined experimentally and are dependent on the amount of fuel (supplied power) and its moisture content. The reason for adjusting the secondary flow is to maintain optimal conditions for emissions and efficiency. It has been apparent from tests under normal running conditions that the optimum point is at a carbon dioxide content of around 18%. This consequently results in somewhat over-stochiometric conditions, with a mean air excess of about 20%.

Figure 2:
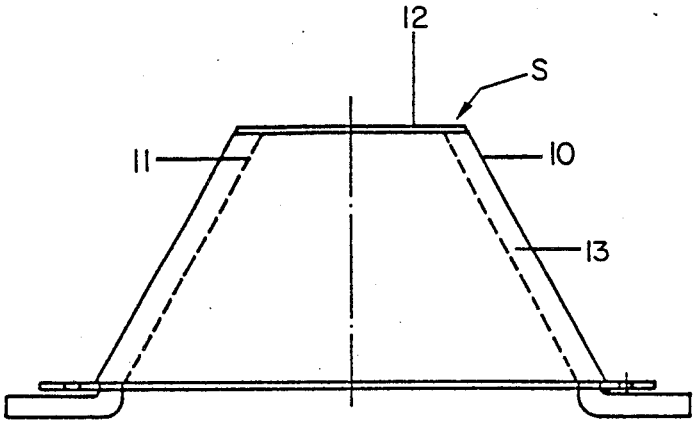
FIG. 2 is a side view of a secondary air supply device for the unit of FIG. 1.
Figure 2A:
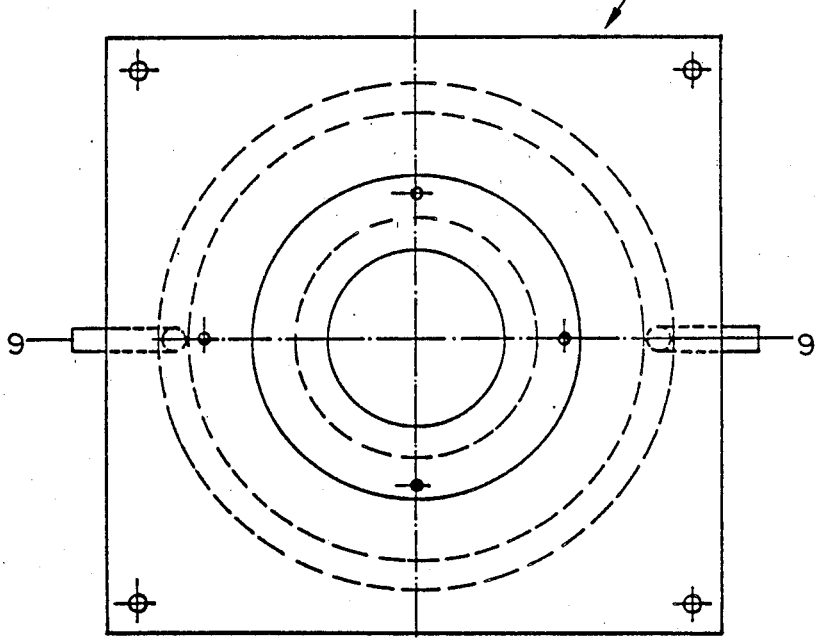
FIG. 2A is a top plan view of the device of FIG. 2A.
Figure 3:
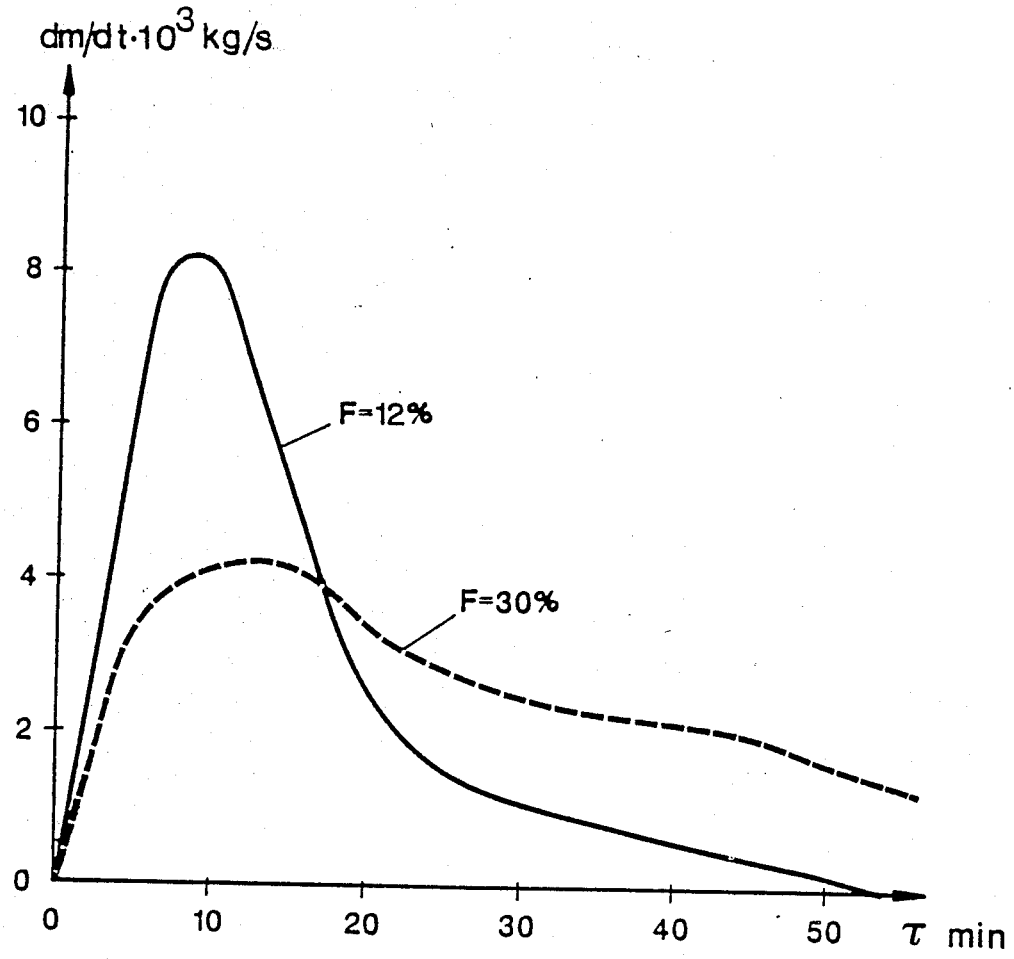
FIG. 3 is a plot showing emission rates of volatile matter for 7 kg of birch at water contents of 12% and 30% water.
Figure 4:
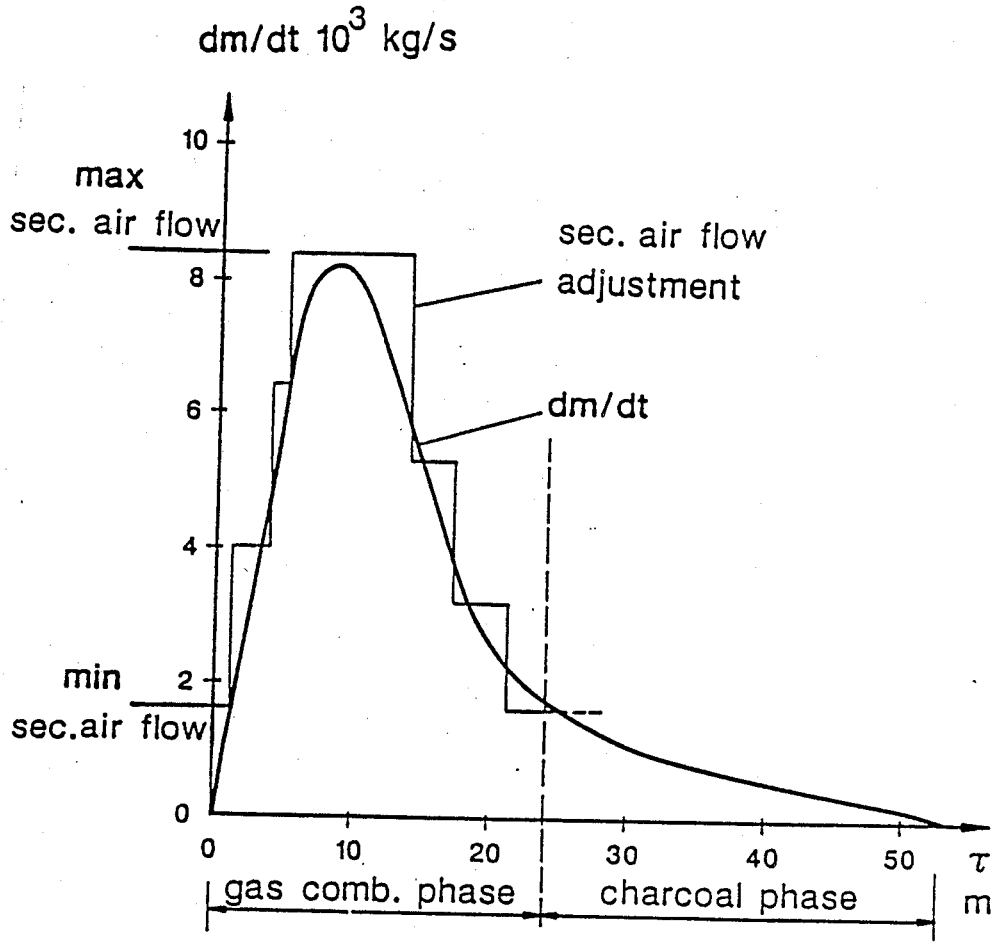
FIGS. 4 and 5 are plots showing secondary and primary air flow adjustments, respectively, in relation to the volatile matter emission rate for the birch at 12% water content.
Figure 5:
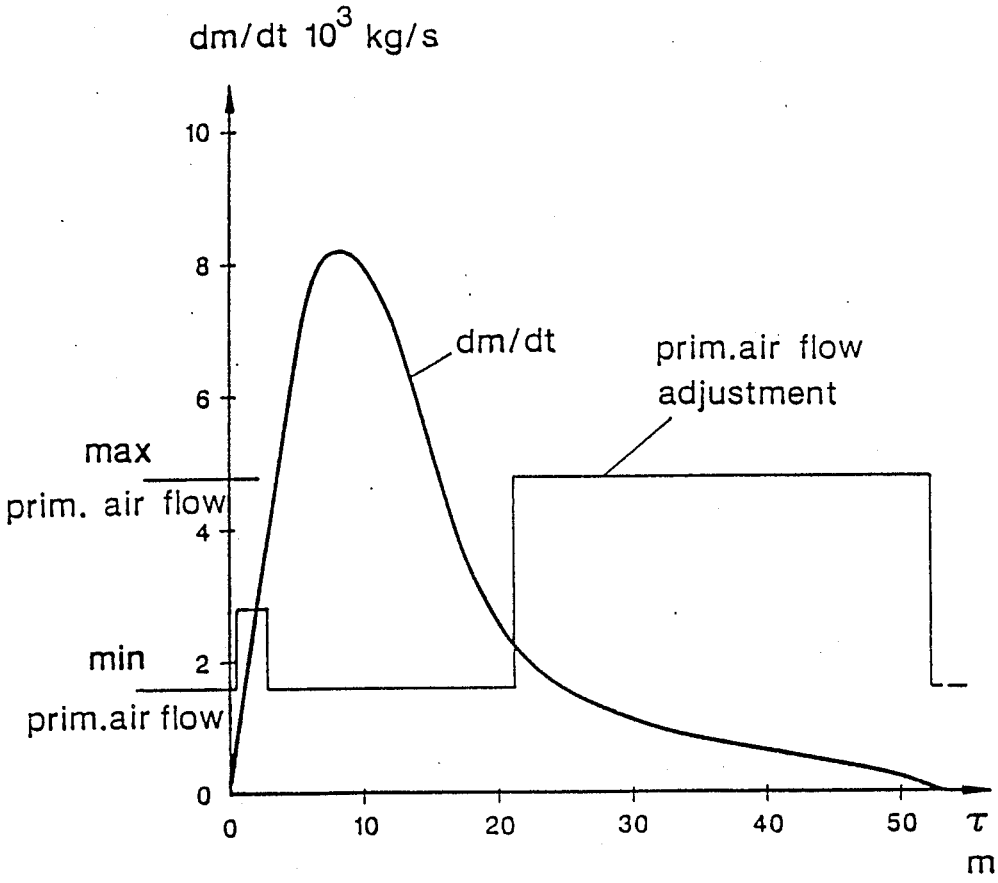
Figure 6:
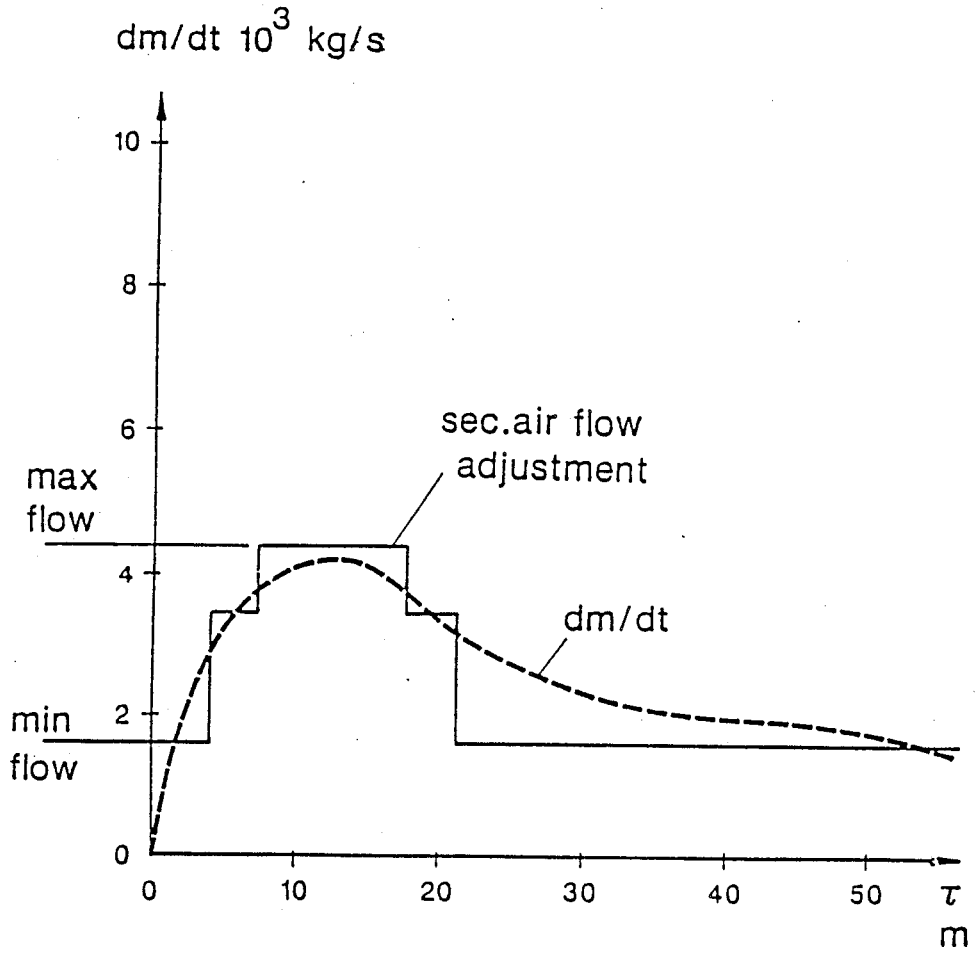
FIGS. 6 and 7 are similar plots for a water content of 30%.
Figure 7:
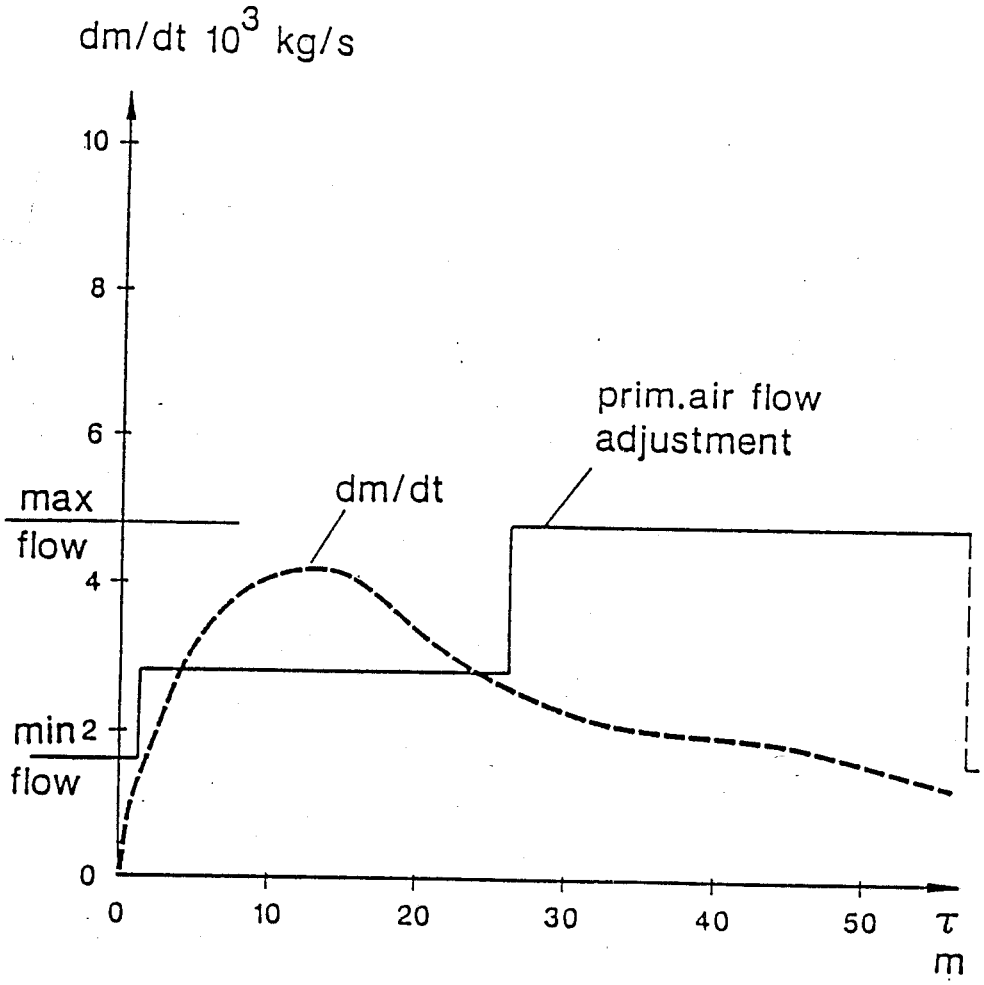

FIG. 3 shows typical curves for the emission rate of volatile matter, dm, dt (kg/s), as a function of the combustion time, t (min) for 7 kg of birch at water contents (F) of 12% and 30%. The curves were determined by weighing the fuel masses at various times under similar combustion conditions. Similar curves may be established for all relevant service conditions and are fundamental for establishing the optimum flow, and in particular the secondary air flow. The curves in FIG. 3 are used to calculate the theoretical oxygen requirement needed to maintain complete combustion. The oxygen supplied to the flame, i.e. the secondary air flow, increases over time with the increase in volatile matter. This is shown schematically in FIG. 4 for the secondary air flow and in FIG. 5 for the primary air flow when burning dry fuel (F=12%). When using moist fuel (F=30%) there are fewer emissions, which means that less air and fewer adjustment stages are needed. FIGS. 6 and 7 show the air adjustment when burning moist fuel.

The performing of the boiler and even the emissions are almost independent of the moisture content of the fuel, but it has been determined that optimum efficiency and emission occur when the fuel contains about 25% water. The induced power of the boiler is determined by the distance D (FIG. 1) between the lower part of the device S and the grate (6). For each boiler size, i.e. a boiler of specified power, there is a lower limit for the amount of fuel needed for optimum performance. This means that the after-burner stage must be functioning for the emissions to be kept down.

Figure 8:
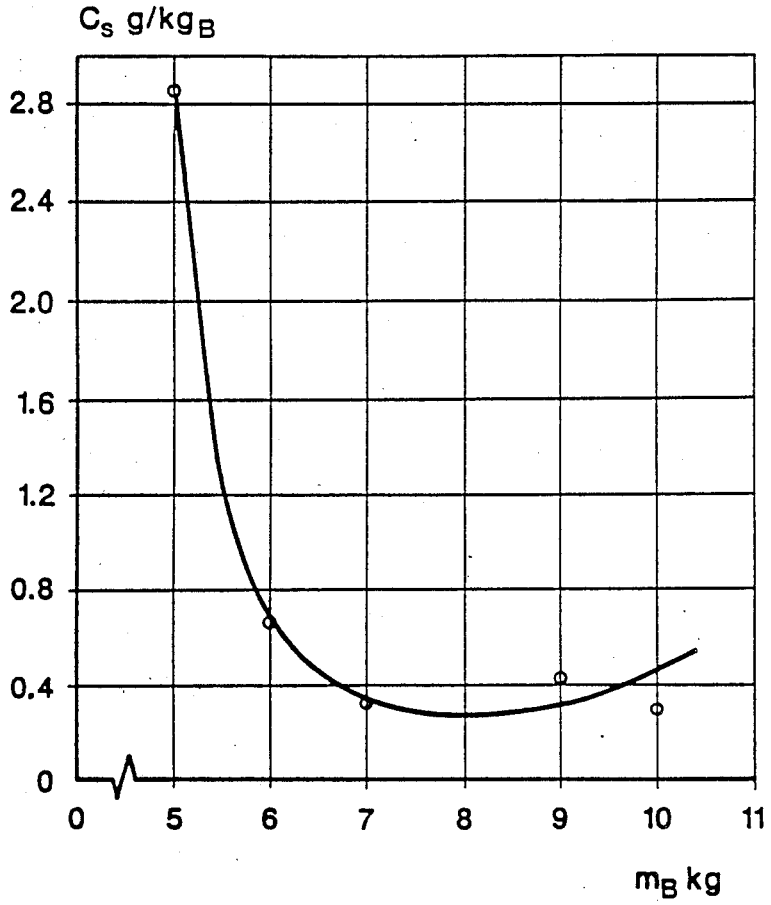
FIG. 8 is a plot of soot generation as a function of fuel amount (constant air flow and water content of about 12%)

FIG. 8 shows how the soot formation varies with the amount of fuel (F about 12%) for a specific boiler size (20–30 kW) at constant air flow. The other emissions, such as carbon monoxide and hydrocarbons, behave in a similar way. The reason for this is that with small amounts of fuel the ignition in the secondary combustion chamber is delayed or insufficient. For amounts of fuel between 6 and 10 kg, FIG. 8 shows that combustion is satisfactory, which suggests that the output can be adjusted within a wide range.

For effective combustion in the fuel support grate, both the amount and pressure of the primary air must be evenly distributed over the whole surface without the removal of ash being affected. As shown in FIG. 9A number of grooves (14) have been cut in the primary air duct (15), perpendicular to its longitudinal axis, to a depth of half the diameter. An even distribution of air over each groove is achieved by means of baffles (16) giving decreasing constriction with increasing distance from the supply air fan. See FIGS. 10–10H, 11, and 11A. The degree of constriction is determined partly by measuring the pressure drop across the baffles and partly by tests with smoke which is introduced into the combustion air.

The grate is constructed in three parts: a horizontal base grate (17) next to the supply air duct and two side grates (18) whose dimensions and in particular the angle of inclination, $\alpha$, may be determined experimentally for a given combustion unit.

As pointed out earlier, the primary air supply is of minor importance during the gas combustion phase. However, this is not the case during the charcoal combustion phase. By means of the two inclined side grates the charcoal residue is progressively collected on the horizontal grate. Fitting the side grates with guide vanes (19) directs the primary air onto the charcoal. Since the charcoal residue is collected on the horizontal grate, the pressure drop across the horizontal grate increases and the greater part of the primary air will pass through the sides. Thus the intense combustion of the charcoal is maintained at high temperatures and levels of carbon dioxide, which favours the combustion efficiency.

Figure 12:
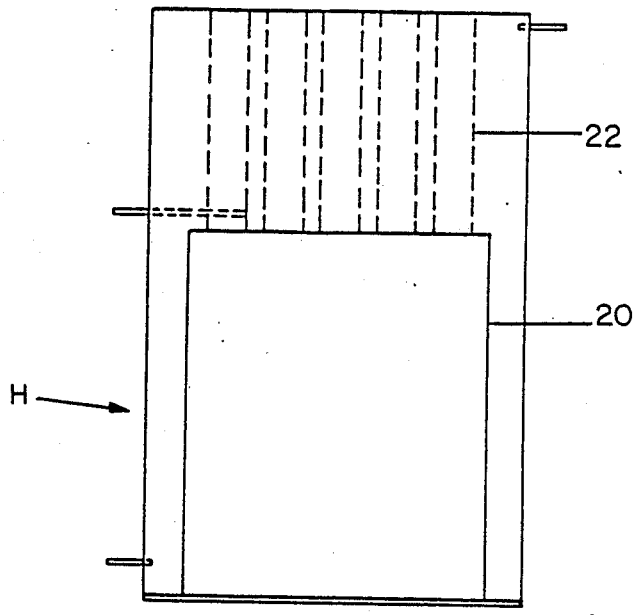
FIG. 12 is a diagrammatic side view of a heat exchanger for use in a boiler incorporating the combustion unit of FIG. 1.
Figure 12A:
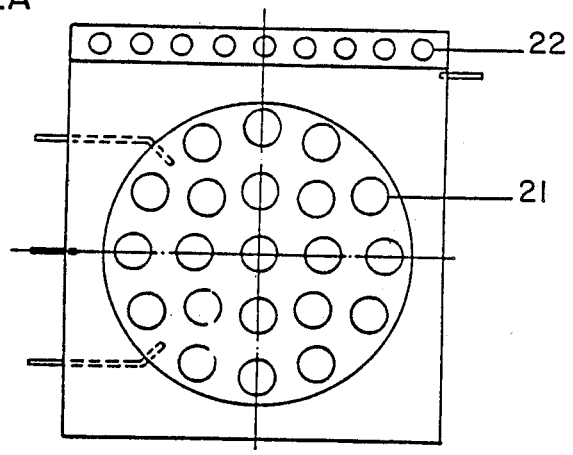
FIG. 12A is a diagrammatic bottom view of the heat exchanger.

FIGS. 12 and 12A depict, diagrammatically, the heat exchanger section H of boiler B.

The heat exchanger is designed so that the heat transfer can be fully exploited during both the gas and coal combustion phases. When the secondary combustion chamber is in use, the heat transfer occurs by both convection and radiation, while it is mainly convective in the charcoal phase. The heat exchanger is also designed to provide a single-family house with hot water (for both space heating and hot-water supply). The volume of hot water should be sufficient for one day, even at the design outdoor temperature. The heat exchanger H is of the so-called through-flow type. Thus there is continuous circulation of water during a combustion cycle. The heated water is stored in a tank (not shown) connected to the heat exchanger.

In the form shown, an open cylindrical part (20) of the heat exchanger is placed above the secondary air device, thus forming the joint secondary combustion chamber (2), (25) so that flaming can be maintained effectively. The flow conditions between the secondary combustion primary and secondary air flow are adjusted to avoid direct contact between the flame and the surfaces of the heat exchanger. The hot flue gases first pass through a number of pipes (21) and are then led down through further pipes (22). The surface of the heat exchanger has been designed by applying a mathematical model. The combustion temperature in the secondary combustion chamber is high and very dependent on the amount of fuel, air flow and moisture content of the fuel. With a relatively dry fuel the temperature in the secondary combustion chamber can go up to more than 1200° C. Because of this, the surface of the heat exchanger is relatively large. However, this is already a given if the efficiency of the system is to be at a favorable level.

Since the boiler is to be fired with fuels of varying heating values and combustion properties, automatic adjustment of flow is preferred for the boiler water. This means that optimum efficiency is maintained under different running conditions. The electronic control unit may adjust the water flow by controlling the speed of a pump and by means of a temperature sensor placed in the supply line. The water flow through the heat exchanger may be determined on the basis of the temperature after the convection part. This temperature is adapted to the quality of the fuel and in particular to prevent condensation on the surface of the heat exchanger and the flue gas duct. The heated boiler water is stored in a tank, as noted earlier, whose volume is in accordance with the heat requirements of the building. However, those skilled in the art will appreciate that, it is an advantage to fire once or maybe twice a day from the point of view of economy and convenience. The tank is not described here, since it will be a conventional tank. Of course, it can be equipped with electrical heating, which can be used when the heat requirements are low or there are economic advantages. One advantage of constructing the boiler to have two separate units, i.e. the heat exchanger and the combustion chamber, is that the heat exchanger can be used as an oil-fired or gas-fired boiler. An oil burner (23) can be connected to the heat exchanger as shown in FIG. 12. As is known, the flue gas temperature with oil firing should not drop below about 200° C. after the convection part. However, owing to the adjustment system for the boiler water, this can be easily achieved by arranging a suitable water flow.

Refined solid fuels such as pellets (of wood or peat), briquettes and chips have been tested by connecting a conventional feed device to a combustion unit according to the invention. The results suggest that both emissions and efficiency are better than with combustion of logs, mainly because of the continuous combustion.

Regarding the emissions, it should be noted that the National Swedish Environment Protection Board has proposed that tar emissions from small solid-fuel units should not exceed the limiting value of 10 mg/MJ. Tests conducted under various combustion and running conditions indicate that this stipulation is met by this invention. During normal running and with fuel containing 10–30% water, the tar level in five out of ten tests was measurable and less than 5.0 mg/MJ, while the condensate in the rest of the cases was completely tar free.

The soot concentration is generally less than 50 $mg/m^3$ of dry flue gas, which corresponds to a soot quantity of around 0.5 g/kg fuel, see FIG. 8. This is considerably lower than the limiting level recommended by the National Swedish Environment Protection Board. The levels of carbon monoxide and hydrocarbons are also low. The mean concentration of carbon monoxide from a complete combustion cycle is less than 500 ppm. It should be noted here that the carbon monoxide level during the flame combustion phase is between 100 and 150 ppm.

I claim:

1. Solid-fuel combustion apparatus, comprising a thermally insulated wall structure defining an upwardly open primary combustion chamber, means disposed in said primary combustion chamber for supporting a solid fuel for combustion, means for supplying primary combustion air to said primary combustion chamber, and a secondary combustion air supply device mounted to said wall structure above said primary combustion chamber, said secondary combustion air supply device comprising a frusto-conical shell open at both axial ends and oriented with its larger axial end opening to said primary combustion chamber, said shell having a spaced inner and outer walls defining a frusto-conical air space therebetween, with said inner and outer walls being circumferentially sealed to one another near both axial ends of said shell and with said inner wall being perforated, and secondary air supply duct means connected in communication with said air space of said frusto-conical shell for supplying secondary combustion air thereto for ejection through the perforations of said inner wall into an exhaust gas stream generated by the solid fuel burning in said primary combustion chamber.

2. Solid-fuel combustion apparatus according to claim 1, wherein the perforations of said inner wall are symmetrically distributed over said inner wall.

3. Solid-fuel combustion apparatus according to claim 2, wherein said perforations are 3–5 mm in diameter.

4. Solid-fuel combustion apparatus according to claim 1, wherein said perforations are 3–5 mm in diameter.

5. Solid-fuel combustion apparatus according to claim 1, further comprising a micro-computer controlled fan connected to said secondary air supply duct means and controlled to supply secondary combustion air at a somewhat over-stoichiometric rate.

6. Solid-fuel combustion apparatus according to claim 1, wherein the opening of the small end of said shell is covered by a plate having a central opening of smaller diameter.

7. Solid-fuel combustion apparatus according to claim 1, further comprising a through-flow type heat exchanger having an open bottom of cross-dimension substantially equal to that of the larger axial end of said frusto-conical shell and placed over and enclosing said frusto-conical shell to define a secondary combustion chamber therewith.

8. Solid-fuel combustion apparatus according to claim 1, wherein said solid fuel supporting means comprises a grate having a horizontal section and inclined sections extending upwardly from said horizontal section, said inclined sections being provided with primary air guide vanes shaped to redirect primary air flowing upwardly through said side sections toward charcoal accumulated on said horizontal section.

9. Solid-fuel combustion apparatus according to claim 8, wherein said primary combustion air supplying means comprises a primary air duct disposed beneath said grate and having a plurality of primary air outlet openings and means for providing even distribution of primary combustion air through said outlet openings.

10. Solid-fuel combustion apparatus according to claim 9, wherein said outlet openings are in the form of radial slits and said even distribution providing means comprises corresponding baffles for said slits mounted in said primary air duct and providing decreasing degrees of constriction of said primary air duct with increasing slit distance from a primary air supply fan connection to said primary air duct.

* * * * *